United States Patent [19]

Neville

[11] Patent Number: 4,830,324

[45] Date of Patent: May 16, 1989

[54] POST BUSHINGS

[75] Inventor: Donald G. Neville, Manhattan Beach, Calif.

[73] Assignee: Illinois Tool Works, Inc., Chicago, Ill.

[21] Appl. No.: 101,733

[22] Filed: Sep. 28, 1987

[51] Int. Cl.[4] ..... A47C 3/18

[52] U.S. Cl. ..... 248/425; 248/159; 248/188.5; 248/188.7; 297/349; 16/2

[58] Field of Search ..... 248/425, 429, 415, 159, 248/188.7, 188.5; 297/349; 108/139; 384/222, 536, 582; 403/225, 221, 322; 102/520–523; 411/510, 526, 527, 521; 16/2

[56] References Cited

U.S. PATENT DOCUMENTS

| | | | |
|---|---|---|---|
| 2,309,839 | 2/1943 | Gardner | 16/2 X |
| 2,672,814 | 3/1954 | Dubost | 102/523 |
| 3,059,888 | 10/1962 | Lie | 248/415 X |
| 3,278,229 | 10/1966 | Bates | 297/349 X |
| 3,684,220 | 8/1972 | Logsdon | 16/2 X |
| 3,740,083 | 6/1973 | Zenhausern | 403/372 X |
| 4,088,241 | 5/1978 | Hall et al. | 16/2 X |
| 4,282,768 | 8/1981 | Osborn | 16/2 X |
| 4,291,904 | 9/1981 | Iversen et al. | 16/2 X |
| 4,487,452 | 12/1984 | Tanizaki et al. | 248/425 X |
| 4,527,483 | 7/1985 | Eichweber | 102/521 |

FOREIGN PATENT DOCUMENTS

| | | | |
|---|---|---|---|
| 1269785 | 6/1968 | Fed. Rep. of Germany | 248/415 |
| 1117113 | 5/1956 | France | 403/221 |
| 1317354 | 1/1963 | France | 411/510 |

*Primary Examiner*—Alvin C. Chin-Shue

*Attorney, Agent, or Firm*—Schwartz & Weinrieb

[57] ABSTRACT

A post bushing for use in a chair assembly, seat post assembly, or other application where a tube is supported around a base. The post bushing includes a flexible umbrella member which secures the outer tube to the post, but which flexes and compresses such that a rigid collar on the bushing can receive the radial load.

8 Claims, 1 Drawing Sheet

POST BUSHINGS

TECHNICAL FIELD

This invention relates to support bushings and more particularly to post bushings used in chair assemblies.

BACKGROUND OF THE INVENTION

A large portion of the seating industry has begun to manufacture chairs in preassembled sections. The sections generally are a base, a seat post assembly including a seat post, and a seat member. A common chair configuration has the seat post assembly being attached to the seat member and the base having a base tube fitted so as to enclose the seat post. The base can be as desired for the particular application, e.g., wheeled or stationary.

The seat member and the seat post assembly can be varied also to add features such as rocking mechanisms, swivel or tilt mechanisms, lumbar supports, height positioning controls, and other chair controls. A wide variety of chairs are manufactured by varying the combination of base, seat post assembly, and seat member used.

Typical chair construction employs bushings. The seat member is joined to the base. Bushings are generally press fitted into the base tube, which is attached to the base. However, if there is any variation in the inner diameter of the base tube, variations in the inner diameter of the bushings result. Variations in the inner diameters of the bushings can make it impossible to insert the seat post unless a secondary machining operation is done on the installed bushings.

It is possible to avoid this secondary machining operation if the inner diameter of the base tube is accurate enough. To be as accurate as required, the base tube must be drawn over a mandrel whereupon, when the bushings are pressed fitted into the base tube, the inner diameters of the bushings remain constant and the seat post can be pressed into the bushings. This alternative is expensive because of the tight tolerances.

Industry practice is to preassemble as much of the chair as possible while keeping the preassembled units compact for shipping and warehousing. For example, after the bushings are pressed in the base, as discussed above, the chair can be shipped as two units, a base and a seat member with a seat post attached.

Thus, it can be appreciated that it would be desirable to have an improved post bushing for use in chair assemblies, as well as in other applications. The improved post bushing should lessen the need to maintain tight tolerances, while allowing preassembly of various components into preassembled units.

SUMMARY OF THE INVENTION

The present invention includes embodiments of a chair assembly and a seat post assembly utilizing a pair of improved post bushings. The bushings themselves are another embodiment of the present invention, which provides a simple and effective means for engaging and supporting a tube around a post.

The chair assembly embodying the present invention has a seat member with an underside, a base member, a seat post attached to the underside of the seat member, a plurality of bushings received each about the seat post, and a base tube joined to the base member and engaged with the bushings. Broadly, the bushings are retained on the seat post, and the base tube is pressed fitted over the bushings.

The present invention may also be embodied in a seat post assembly comprising a seat post, with a plurality of bushings installed. The bushings used are as described hereinafter in detail, with additional features which allow attachment of the bushings to the seat post itself.

According to the present invention, such a bushing includes a cylindrical sleeve and an annular umbrella member, which has an inner diameter and an outer diameter. The umbrella member is attached integrally and protrudes from the cylindrical sleeve. The bushing further includes, in spaced relation to the annular umbrella member, a rigid collar which also protrudes from the cylindrical sleeve. The rigid collar has an outer diameter smaller than the outer diameter of the annular umbrella member when the annular umbrella member is in an unflexed and uncompressed state.

In an assembly utilizing such a bushing, when the base or outer tube engages the bushing, the annular umbrella member flexes and compresses so that the base tube contacts some portion of the periphery of the rigid collar. Thus, when the chair receives a radial load, such load is transferred to the base by the bushing. Alternative embodiments of such a bushing include a bushing which has a thrust flange portion to distribute the axial load received and a bushing which has an end cap.

A post bushing in accordance with the present invention allows greater variances in the diameters of the base tube and the seat post while still allowing for preassembly. The improvement provided in the bushing by the annular umbrella member can be employed in a variety of applications which use a post and a tube.

DESCRIPTION OF THE PREFERRED EMBODIMENT

Figure 1:
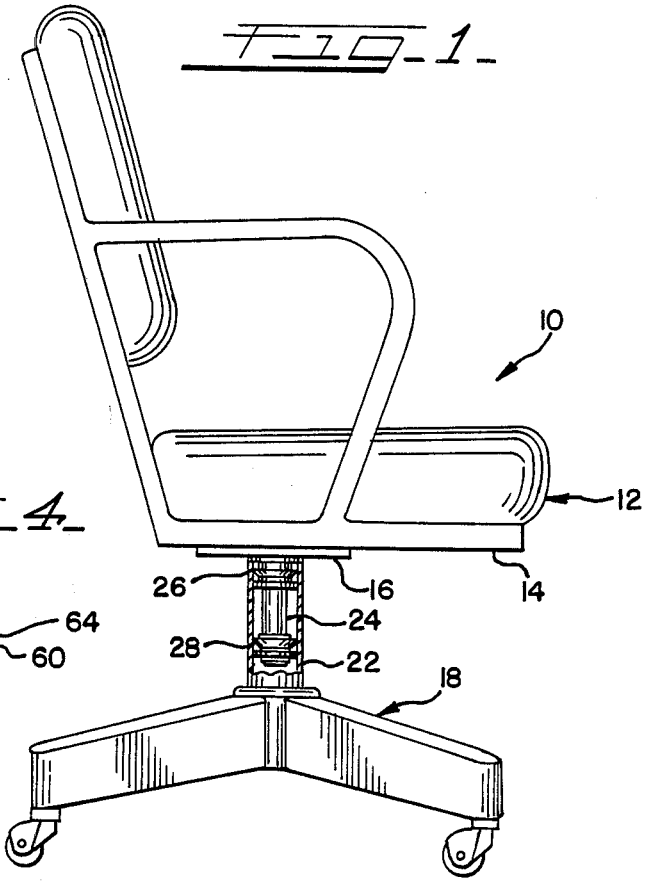
FIG. 1 is a fragmentary, side elevational view of a chair assembly embodying the present invention.

Referring to the drawings, FIG. 1 shows an embodiment of the post bushings of the present invention in a chair assembly 10. The chair assembly 10 includes a seat member 12 having an underside 14. The illustrated embodiment also includes a seat post base 16. The seat post base 16 may be a simple bracket, a swivel or tilt mechanism, or some other chair mechanism, the variations not being important to the hereinafter-described invention. The chair assembly further includes a seat post 24, which is attached to the underside 14 of the seat member 12, and a pair of annular bushings 26 and 28, each of which is received about the seat post 24. A base tube 22 is joined to the base member 18 and is engaged by the bushings 26 and 28.

The bushings 26 and 28 not only engage the base tube 22 but also support the base tube against radial loads and axial thrust loads. Such radial load is supported by a pair of rigid collars 36 and 42 while such an axial thrust load is supported by a thrust flange 32. The rigid collars 36 and 42 and the thrust flange 32 will be hereinafter discussed in detail.

Figure 2:
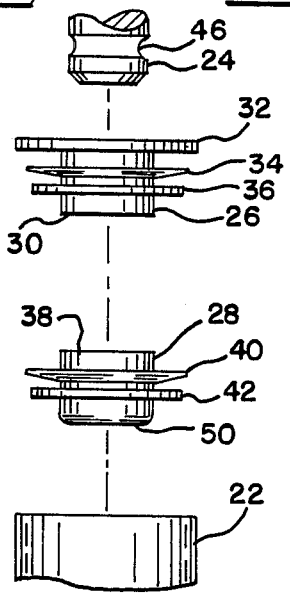
FIG. 2 is an enlarged, exploded, fragmentary side view of a seat post assembly, as used in the chair assembly of FIG. 1.
Figure 3:
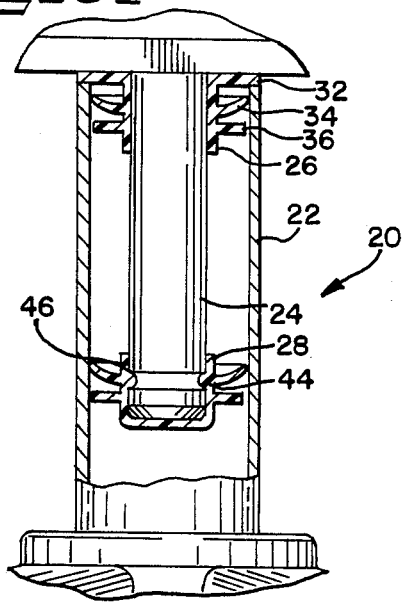
FIG. 3 is a similarly enlarged, fragmentary, axial-sectional view of the seat post assembly of FIG. 2.

FIGS. 1, 2 and 3 show two variants of post bushings. Post bushing 26 is a tubular bushing with the thrust flange 32 attached. Post bushing 28 is a cap-like bushing.

The tubular bushing 26 includes a cylindrical sleeve 30, an annular umbrella member 34, a rigid collar 36, and a thrust flange 32. The umbrella member 34 is joined integrally to the cylindrical sleeve 30 where the umbrella member 34 extends to its outmost diameter, the material of the umbrella member 34 tapers to form a thin-sectioned outer periphery. The taper of umbrella member 34 is best seen in FIG. 3. The tapered configuration of the umbrella member 34 allows for flexion and compression. Herein, flexion and compression of the annular umbrella member 34 refer to its change from a flattened configuration, as shown in FIG. 2, to a dished configuration, as shown in FIG. 3.

The rigid collar 36 is also joined integrally to the cylindrical sleeve 30. The rigid collar 36 protrudes from the cylindrical sleeve 30 at a substantially constant thickness, which is sufficient to withstand radial loads without significant reduction or other variation in the inner diameter of the tubular bushing 26. The thickness of the rigid collar 36 can vary depending on the radial load which the rigid collar 36 is designed to carry. The thrust flange 32, which extends outwardly from the periphery of the cylindrical sleeve 30, is oriented so that the annular umbrella member 34 flexes towards the thrust flange 32. This orientation allows the base tube 22 to flex and compress the annular umbrella member 34 so as to be able to engage the thrust flange 32. The thickness of the thrust flange 32 will vary with the load which the thrust flange 32 is designed to carry.

Similarly, the cap-like bushing 28 includes a cylindrical sleeve 38, an umbrella member 40, and a rigid collar 42. The cap-like bushing 28 also includes an end-cap portion 50, which is joined integrally to the cylindrical sleeve 38 so as to form a cap for the seat post 24. The cap-like bushing 28 is configured to function substantially as the tubular bushing 26 functions. The umbrella member 40 flexes and compresses so as to allow the rigid collar 42 to be engaged by an enveloping tube such as the base tube 22. The radial load is supported by the rigid collar 42.

The cap-like bushing further includes an annular protrusion 44 provided around the inner diameter and spaced from the edge of the bushing 28. The protrusion 44, which is semi-circular in cross-section, as shown, is adapted to be received in a mating groove 46 on the distal end of the seat post 24. This protrusion 44 and groove 46 snap-fit together so as to secure the cap-like bushing 28 to the seat post 24.

Figure 4:
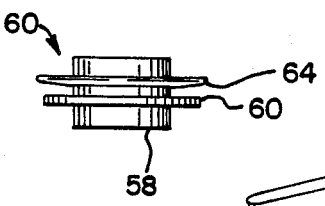
FIG. 4 is an enlarged side elevational view of a post bushing constituting an alternative embodiment of this invention.

An alternate embodiment of such a bushing, as shown in FIG. 4, is a tubular post bushing 60, without an end cap or a thrust flange. The post bushing 60 includes an annular umbrella member 64 and a rigid collar 62, each protruding from a cylindrical sleeve 64. The post bushing 60 can be keyed, press-fitted, or attached in any other suitable manner to a mating post. Once the post bushing 60 is secured to such a post, an outer tube similar to base tube 22 can be pushed over the post bushing 60, the outer tube flexing and compressing the umbrella member 64 and engaging the rigid collar 62.

In FIG. 1, two bushings are shown. Two is the preferred number of post bushings because the base tube generally makes contact only at the top and the bottom of the post. However, an alternate embodiment could include a greater number of post bushings including tubular post bushings with and without thrust flanges and including a cap-like bushing.

It will be readily observed from the foregoing detailed description of the invention and from the illustrated embodiments thereof that numerous variations and modifications may be effected without departing from the true spirit and scope of the novel concepts or principles of this invention.

What is claimed:

1. A chair seat post assembly for attachment to an undersurface portion of a chair seat member and for engagement with an inner peripheral wall surface of a chair base tube having a predetermined inner diametrical extent, comprising:

a dependent seat post having a first proximal end thereof attachable to said undersurface portion of said chair seat member and having a second distal end thereof disposed below said first proximal end of said seat post;

a tubular bushing disposed about said seat post within the vicinity of said first proximal end of said seat post;

a cap-like bushing having a closed end and disposed around and over said second distal end of said seat post;

said bushings being disposed within said chair base tube so as to support said chair base tube relative to said chair seat post;

said tubular bushing and said cap-like bushing each comprising:

a cylindrical sleeve disposed about said chair seat post;

a flexible, inverted annular umbrella member, having A curvature which extends in the direction such that an outer convex portion thereof is disposed toward said closed end of said cap-like bushing, integrally attached at an inner diameter portion thereof to an outer peripheral portion of said cylindrical sleeve and having an outer diametrical extent which is greater than said inner diametrical extent of said chair base tube such that upon insertion of said bushings into said chair base tube, said umbrella members are flexibly compressed in their predetermined curvature directions so as to flexibly engage said inner peripheral wall surface of said chair base tube; and a rigid collar, integrally attached at an inner diameter portion thereof to an outer peripheral portion of said cylindrical sleeve in spaced relation to said umbrella member, having an outer diametrical extent which is smaller than said inner diametrical extent of said chair base tube and said outer diametrical extent of said annular umbrella member when said annular umbrella member is flexibly engaged with said inner peripheral wall surface of said chair base tube such that when a radial load is impressed upon said chair seat post assembly, said annular umbrella member will be sufficiently compressed still further so as to allow said chair base tube to contact said rigid collar whereby said interengagement of said rigid collar and said chair base tube will withstand said impressed radial load and stably support said chair base tube and said chair seat post assembly relative to each other.

2. A chair seat post assembly in accordance with claim 1, further comprising:

a thrust flange integrally attached to said tubular bushing, each of said umbrella members being flexible toward said thrust flange.

3. A chair seat post assembly as set forth in claim 2, wherein:

said thrust flange is integrally attached to an uppermost end portion of said tubular bushing and extends radially outwardly so as to have a peripheral portion thereof interposed between an uppermost end portion of said chair base tube and said undersurface portion of said chair seat member.

4. A chair seat post assembly as set forth in claim 1, further comprising:

annular groove means defined upon an outer peripheral surface portion of said chair seat post within the vicinity of said second distal end thereof; and annular, radially inwardly projecting protrusion means provided upon an inner peripheral surface portion of said cylindrical sleeve of said cap-like bushing for matingly engaging with said annular groove means of said chair seat post in order to snapfittingly mount said cap-like bushing upon said chair seat post.

5. A chair seat post assembly for attachment to an undersurface portion of a chair seat member and for engagement with an inner peripheral wall surface of a chair base tube having a predetermined inner diametrical extent, comprising:

a dependent seat post having a first proximal end thereof attachable to said undersurface portion of said chair seat member and having second distal end thereof disposed below said first proximal end of said seat post;

a first bushing disposed about said seat post within the vicinity of said first proximal end of said seat post;

a second bushing disposed about said seat post within the vicinity of said second distal end of said seat post;

said bushings being disposed within said chair base tube so as to support said chair base tube relative to said chair seat post, and each of said bushings comprising:

a cylindrical sleeve disposed about said chair seat post;

a flexible, inverted annular umbrella member, having a curvature which extends in the direction such that an outer convex portion thereof is disposed toward said second distal end of said chair seat post, integrally attached at an inner diameter portion thereof to an outer peripheral portion of said cylindrical sleeve and having an outer diametrical extend which is greater than said inner diametrical extent of said chair base tube such that upon insertion of said bushings into said chair base tube, said umbrella members are flexibly compressed in their predetermined curvature directions so as to flexibly engage said inner peripheral wall surface of said chair base tube; and a rigid collar, integrally attached at an inner diameter portion thereof to an outer peripheral surface portion of said cylindrical sleeve in spaced relation to said umbrella member, having an outer diametrical extent which is smaller than said inner diametrical extent of said chair base tube and said outer diametrical extend of said annular umbrella member when said annular umbrella member is flexibly engaged with said inner peripheral wall surface of said chair base tube such that when a radial load is impressed upon said chair seat post assembly, said annular umbrella member will be sufficiently compressed still further so as to allow said chair base tube to contact said rigid collar whereby said interengagement of said rigid collar and said chair base tube will withstand said impressed radial load and stably support said chair base tube and said chair seat post assembly relative to each other.

6. A chair seat post assembly in accordance with claim 5, wherein one of said bushings has an integrally formed cap-like end and has an annular protrusion formed within said cylindrical sleeve, said annular protrusion being snap-fittingly receivable within a groove on said seat-post.

7. A chair seat post assembly in accordance with claim 5, further comprising:

a thrust flange integrally attached to said cylindrical sleeve of one of said bushings, said umbrella members being flexible toward said thrust flange.

8. A chair seat post assembly as set forth in claim 7, wherein:

said thrust flange is integrally attached to an uppermost end portion of said first bushing and extends radially outwardly so as to have a peripheral portion thereof interposed between an uppermost end portion of said chair base tube and said undersurface portion of said chair seat member.

* * * * *